US007832899B2

(12) United States Patent
Zheng

(10) Patent No.: US 7,832,899 B2
(45) Date of Patent: Nov. 16, 2010

(54) LED LAMP WITH HEAT SINK

(75) Inventor: Shi-Song Zheng, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 202 days.

(21) Appl. No.: 12/195,433

(22) Filed: Aug. 21, 2008

(65) Prior Publication Data

US 2009/0268464 A1 Oct. 29, 2009

(30) Foreign Application Priority Data

Apr. 23, 2008 (CN) ..... 2008 1 0066773

(51) Int. Cl.
*F21V 21/00* (2006.01)

(52) U.S. Cl. ..... 362/249.02; 362/294; 362/800

(58) Field of Classification Search .....
362/249.02–249.06, 294, 240, 236, 800
See application file for complete search history.

(56) References Cited

U.S. PATENT DOCUMENTS

| | | | | |
|---|---|---|---|---|
| 5,014,171 | A * | 5/1991 | Price, III | 362/277 |
| 5,567,036 | A * | 10/1996 | Theobald et al. | 362/485 |
| 5,785,418 | A * | 7/1998 | Hochstein | 362/373 |
| 6,452,217 | B1 * | 9/2002 | Wojnarowski et al. | 257/99 |
| 7,593,229 | B2 * | 9/2009 | Shuy | 361/705 |

* cited by examiner

*Primary Examiner*—David V Bruce
(74) *Attorney, Agent, or Firm*—Frank R. Niranjan

(57) ABSTRACT

An LED lamp includes a plurality of LED modules, a heat absorbing member, a heat sink and an envelope. The heat absorbing member comprises a plurality of inclined top boards oriented toward different directions and a plurality of horizontal bottom boards located below and connecting with corresponding top boards. A plurality of air passages is defined between the top board and the bottom board. Each of the LED modules is attached on a corresponding top board. The heat sink thermally contacts the heat absorbing member. The envelope is mounted on the heat sink and engages with the heat sink to enclose the heat absorbing member and LED modules therein.

20 Claims, 3 Drawing Sheets

LED LAMP WITH HEAT SINK

BACKGROUND

1. Field of the Invention

The present invention relates to a light emitting diode (LED) lamp, and more particularly to an LED lamp having a heat sink for improving heat dissipation efficiency of the LED lamp.

2. Description of Related Art

An LED lamp is a type of solid-state lighting that utilizes light-emitting diodes (LEDs) as a source of illumination. The LED lamp is intended to be a cost-effective yet high quality replacement for incandescent and fluorescent lamp because of the LED making features of long-term reliability, environment friendliness and low power consumption.

A conventional LED lamp comprises a heat sink and a plurality of LED modules having LEDs attached on an outer surface of the heat sink to dissipate heat generated by the LEDs. The outer surface of the heat sink generally is a plane. When the LED lamp works, the LEDs mounted on the planar outer surface of the heat sink only form a flat light source, whereby the illumination area and angle of the LED lamp are limited. In addition, the heat sink of the conventional LED lamp cannot efficiently dissipate the heat generated by the LEDs.

What is needed, therefore, is an LED lamp having a large illumination area and angle. Furthermore, the LED lamp has a good heat dissipation efficiency.

SUMMARY

An LED lamp includes a plurality of LED modules, a heat absorbing member, a heat sink and an envelope. The heat absorbing member comprises a plurality of inclined top boards oriented toward different lateral directions and a plurality of horizontal bottom boards located below and connecting with corresponding top boards. A plurality of air passages is defined between the top board and the bottom board. Each of the LED modules is attached on a corresponding top board. The heat sink thermally connects with the heat absorbing member. The envelope is mounted on the heat sink and engages with the heat sink to enclose the heat absorbing member and LED modules therein. The envelope is made of transparent material such as glass or plastic.

Other advantages and novel features of the present invention will become more apparent from the following detailed description of an embodiment/embodiments when taken in conjunction with the accompanying drawings.

BRIEF DESCRIPTION OF THE DRAWINGS

Many aspects of the present invention can be better understood with reference to the following drawings. The components in the drawings are not necessarily drawn to scale, the emphasis instead being placed upon clearly illustrating the principles of the present invention. Moreover, in the drawings, like reference numerals designate corresponding parts throughout the several views.

DETAILED DESCRIPTION

Figure 1:
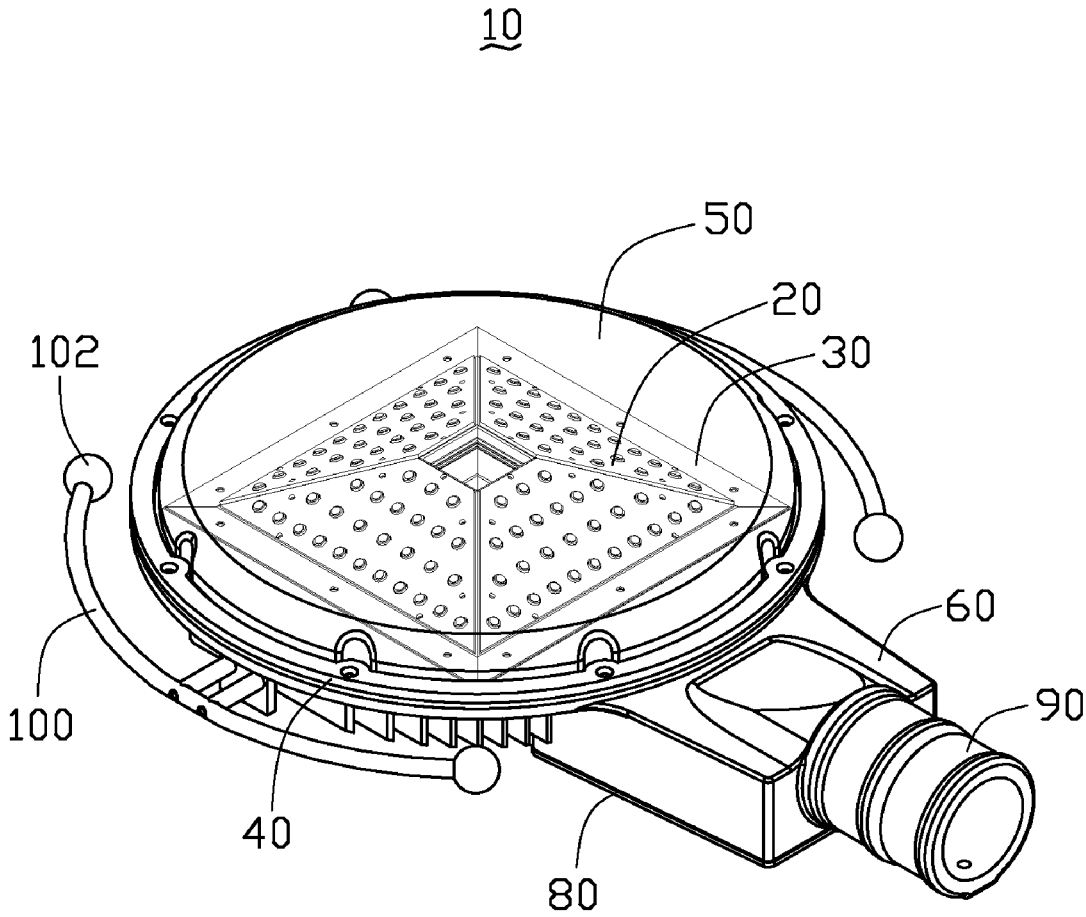
FIG. 1 is an assembled, isometric view of an LED lamp with a heat sink in accordance with a preferred embodiment of the present invention.
Figure 2:
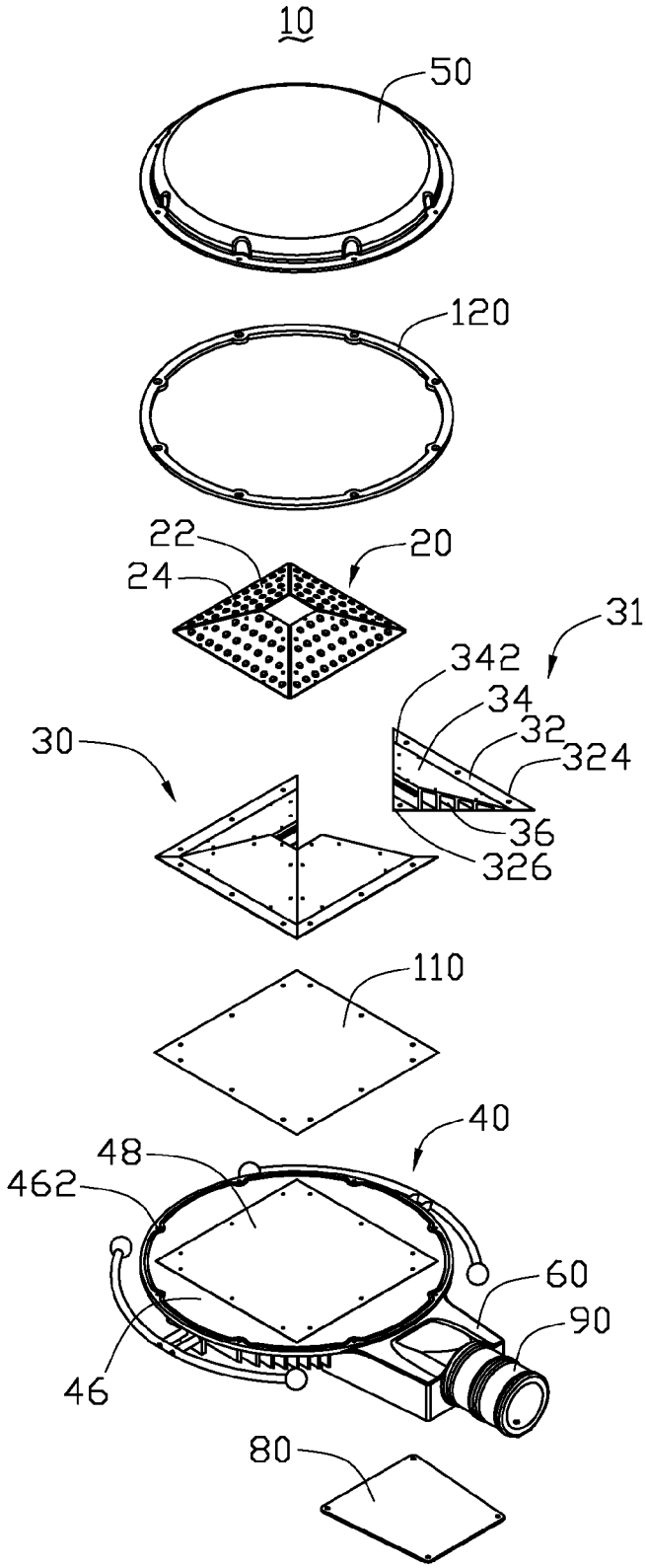
FIG. 2 is an exploded view of FIG. 1.

Referring to FIG. 1 and FIG. 2, an LED lamp 10 in accordance with an embodiment of the present invention includes a plurality of LED modules 20, a heat absorbing member 30 on which the LED modules 20 are attached, a heat sink 40 connected with the heat absorbing member 30 and located at a bottom of the heat absorbing member 30 and an envelope 50 mounted on a top of the heat sink 40 and enclosing the heat absorbing member 30 and the LED modules 20 therein. A shell 60 protrudes from an end of the heat sink 40. A cover 80 engages with the shell 60 to receive a driving circuit module 70 (shown in FIG. 3) therein. A socket 90 is disposed at an end of the shell 60 and is away from the heat sink 40 in order to connect with a lamp post (not shown). The driving circuit module 70 is electrically connected with the LED modules 20. A circular, waterproof pad 120 is sandwiched between the envelope 50 and the heat sink 40. A pair of arc-shaped shafts 100 is mounted on opposite sides of the LED lamp 10 to decorate the LED lamp 10. A pair of balls 102 is mounted on opposite ends of the shaft 100.

Referring to FIG. 2 again, each of the LED modules 20 comprises a trapezoid printed circuit board 22 and a plurality of LEDs 24 evenly mounted on a side of the printed circuit board 22. Another side of the printed circuit board 22 is attached on the heat absorbing member 30. The LEDs 24 are arrayed in many rows; each row is parallel to a top edge of the printed circuit board 22; two ends of each row extend to corresponding edges of the printed circuit board 22. These printed circuit boards 22 on the absorbing member 30 cooperatively form a frustum of a prism profile.

The heat absorbing member 30 is made from metal such as aluminum. The heat absorbing member 30 consists of four heat absorbing portions 31. Each of the heat absorbing portions 31 comprises a triangular bottom board 32, a top board 34 mounted above the bottom board 32 and a plurality of connecting boards 36 interconnecting the bottom board 32 and the top board 34. The top board 34 is inclined while the bottom board 32 is horizontal.

The top board 34 has an isosceles trapezoid configuration. An acute angle is defined between the top board 34 and the bottom board 32. The top board 34 intersects the bottom board 32 at an edge 342 which is parallel to an outer edge 324 of the bottom board 32. The outer edge 324 is spaced from the edge 342 and located outside the edge 342. A projection of the top board 34 on the bottom board 32 laps over the bottom board 32.

The connecting board 36 is perpendicular to the bottom board 32. These connecting boards 36 are parallel to each other, and are spaced from each other to define a plurality of air passages (not shown) therebetween. Heights of the connecting boards 36 are gradually increased along a direction from the outer edge 324 inwardly toward a center of the heat absorbing member 30.

Figure 3:
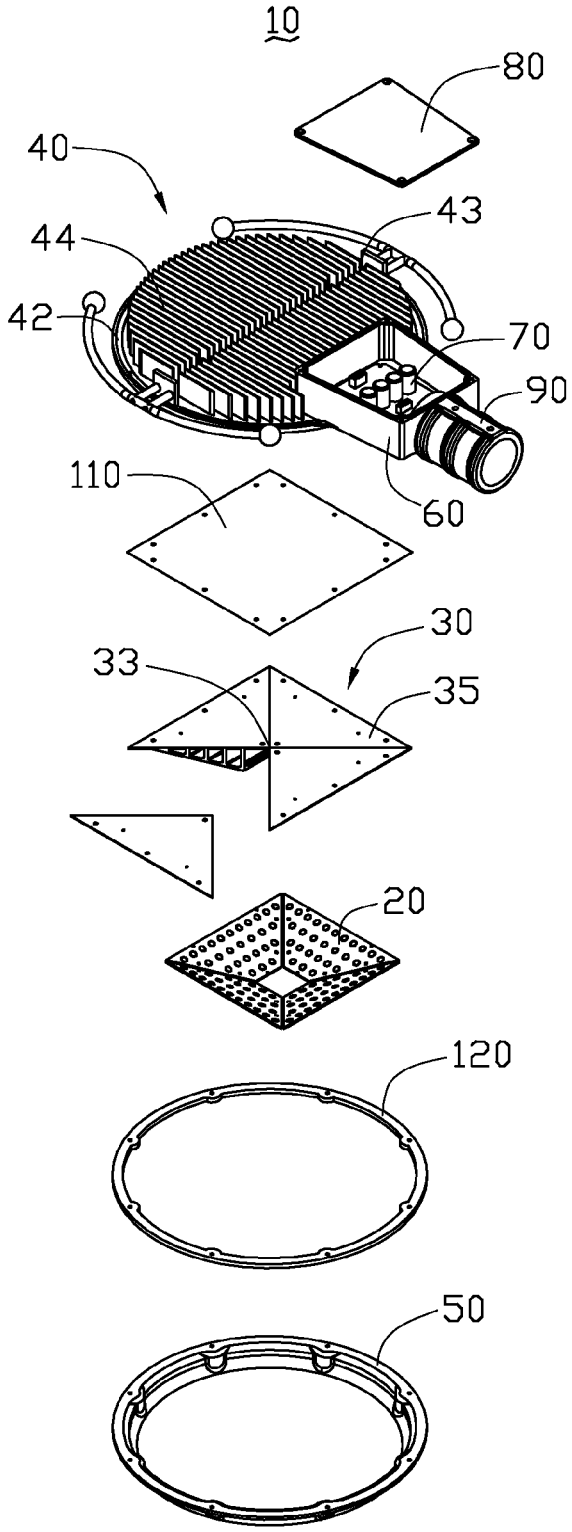
FIG. 3 is a view similar to FIG. 2, but viewed from another aspect.

Referring to FIGS. 2-3, the four heat absorbing portions 31 are symmetrically disposed around a central axis of the heat absorbing member 30. A space is defined on a top of the heat absorbing member 30. Apexes 326 of the heat absorbing portions 31 are assembled together to define a central point 33 of the heat absorbing member 30. These bottom boards 32 of the heat absorbing portions 31 are coplanar to define a square bottom face 35. Due to the acute angle defined between the top board 34 and the bottom board 32, the top boards 34 of the heat absorbing member 30 are oriented toward different lateral directions. Each of the LED modules 20 is attached on the top board 34 of the corresponding heat absorbing portion 31. An area of the printed circuit board 22 is identical to that of the top board 34. The areas of the printed circuit board 22 and the top board 34 can be different in different embodiments. A number of the heat absorbing portions 31 is identical to that of the LED modules 20. The numbers of the heat absorbing portions 31 and the LED modules 20 can be different in different embodiments. In this embodiment, the numbers of the heat absorbing portions 31 and the LED modules 20 are both four. A lightness of the LED lamp 10 can be changed by changing the number of the LED modules 20.

Referring to FIG. 3, the heat sink 40 has a discal configuration and is made of metal or alloy having a good heat conductivity, such as aluminum or copper or an alloy thereof. The heat sink 40 comprises a discal base 42 and a fin unit 44 extending integrally from a bottom of the base 42 perpendicularly. The fin unit 44 consists of a plurality of fins which are parallel to and spaced from each other. A plurality of air passages (not shown) is defined between these fins. A channel 43 is defined at a central position of these fins. The channel 43 is perpendicular to each of the fins. A cutout (not shown) is defined at an edge of the fin unit 44 in order to receive the shell 60 therein. Referring to FIG. 2 also, a round platform 46 projects perpendicularly and integrally from a top of the base 42. A plurality of recesses 462 is evenly formed at a periphery of the platform 46. A threaded hole (not labeled) is defined in the base 42 locating in a corresponding recess 462. A screw (not shown) is used to extend through a hole (not labeled) in a periphery of the envelope 50 and a hole (not labeled) in the pad 120 to threadedly engage in a corresponding threaded hole thereby assembling the base 42, the pad 120 and the envelope 50 together. A substantially square protrusion 48 extends upwardly from a center of a top of the platform 46 integrally and perpendicularly; an area of the protrusion 48 is identical to that of the bottom face 35 of the heat absorbing member 30 and can be different in other embodiments. In this embodiment, a substantially square, board-shaped conducting member 110 is sandwiched between the heat sink 40 and the heat absorbing member 30 to transfer heat generated by the LED modules 20 from the heat absorbing member 30 to the heat sink 40. A bottom face of the conducting member 110 is attached on the protrusion 48. A top face of the protrusion 48 needs to be processed to increase a flatness thereof in order to improve a heat conducting efficiency between the protrusion 48 and the conducting member 110. Areas of the protrusion 48 and the bottom face 35 of the heat absorbing member 30 are identical to that of the conducting member 110, and can be different in other embodiments. In other embodiments, the conducting member 110 can be omitted.

The envelope 50 has a bowl-shaped construction. The envelope 50 is generally made of transparent material such as plastic, glass, or other suitable material availing to transmit light. The envelope 50 is mounted on the top of the heat sink 40, and engages with the heat sink 40 to define a receiving space in order to receive the LED modules 20 and the heat absorbing member 30 therein.

In assembly of the LED lamp 10, the LED modules 20 are mounted on the heat absorbing member 30 via screws (not shown). The bottom boards 32 of the heat absorbing member 30 and the conducting member 110 are mounted on the heat sink 40, and then the envelope 50 engages with the periphery of the platform 46 of the heat sink 40 to define a waterproof space in order to receive the heat absorbing member 30 and the LED modules 20 therein.

The shell 60 is disposed on a lateral end of the heat sink 40. The shell 60 has a part received in the cutout of the heat sink 40, and another part thereof protruded from the base 40.

In use of the LED lamp 10, when the LEDs 24 of the LED modules 20 emit light, heat generated by the LEDs 24 is absorbed by the heat absorbing member 30 and then transferred to the heat sink 40 by the conducting member 110. Most of the heat is dispersed into ambient cool air by the fins of the fin unit 44. Thus, a temperature of the LEDs 24 is decreased and the LED lamp 10 has an improved heat dissipation efficiency for preventing the LEDs 24 from overheating. Additionally, due to the acute angle defined between the top board 34 and the bottom board 32 and four heat absorbing portions 31 symmetrically disposed around the central axis of the heat absorbing member 30, the top boards 34 of the heat absorbing member 30 are oriented toward different directions. Consequently, the LED modules 20 attached on the top boards 34 are also oriented toward different directions; therefore, light radiated from the LED modules 20 is distributed over a large region.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A light emitting diode (LED) lamp comprising:

a plurality of LED modules;

a heat absorbing member having a top thereof defining a space therein, the heat absorbing member comprising a plurality of heat absorbing portions, each of the heat absorbing portions comprising an inclined top board and a horizontal bottom board, the LED modules being attached on the top boards, respectively, a plurality of air passages being defined between the top board and the bottom board, the top boards being oriented toward different lateral directions;

a heat sink thermally contacting the heat absorbing member; and an envelope being mounted on the heat sink and engaging with the heat sink to enclose the heat absorbing member and the LED modules therein.

2. The LED lamp as claimed in claim 1, wherein each of the heat absorbing portions further comprises a plurality of parallel and spaced connecting boards connecting the top board and the bottom board.

3. The LED lamp as claimed in claim 1, wherein the bottom boards are coplanar with each other and define a bottom face facing the heat sink.

4. The LED lamp as claimed in claim 1, wherein an acute angle is defined between the top board and the bottom board, the top board intersecting the bottom board at an intersection line.

5. The LED lamp as claimed in claim 4, wherein the intersection line is spaced from an outer edge of the bottom board.

6. The LED lamp as claimed in claim 1, wherein the heat absorbing portions are symmetrically disposed around a central axis of the heat absorbing member.

7. The LED lamp as claimed in claim 1, wherein the bottom board is triangular, the top board is trapezoid.

8. The LED lamp as claimed in claim 1, wherein the top board has a projection lapping over the bottom board.

9. The LED lamp as claimed in claim 1, wherein the heat sink comprises a discal base and a fin unit extending integrally from a bottom of the base perpendicularly, a platform projecting perpendicularly and integrally from a top of the base.

10. The LED lamp as claimed in claim 9, wherein a plurality of recesses is evenly formed at a periphery of the platform to engage with the envelope, a substantially square protrusion extending upwardly from a top of the platform integrally and perpendicularly.

11. The LED lamp as claimed in claim 10, wherein the envelope engages with the recesses of the heat sink to define a waterproof space receiving the heat absorbing member and the LED modules therein.

12. The LED lamp as claimed in claim 10 further comprising a heat conducting member, wherein the heat conducting member is sandwiched between the heat sink and the heat absorbing member.

13. The LED lamp as claimed in claim 9, further comprising a shell receiving a driving circuit board therein, wherein a cutout is defined at an edge of the fin unit, the shell having a part thereof received in the cutout and having another part thereof protruded from the base.

14. The LED lamp as claimed in claim 1, wherein the bottom board of each of the heat absorbing portions has a tip, the tips of the bottom boards put together to form a central portion, the space defined in the top of the heat absorbing member corresponding to the central portion.

15. A light emitting diode (LED) lamp comprising:

a plurality of LED modules;

a heat absorbing member having a top thereof defining a space therein, the heat absorbing member comprising a plurality of inclined top boards oriented toward different lateral directions and a plurality of bottom boards being opposite to corresponding top boards, each of the LED modules being attached on the top board;

a heat sink thermally contacting the heat absorbing member; and an envelope being mounted on the heat sink and engaging with the heat sink to enclose the heat absorbing member and the LED modules therein.

16. The LED lamp as claimed in claim 15, wherein the heat absorbing member comprises a plurality of heat absorbing portions, each of the heat absorbing portions comprising a corresponding top board, a corresponding bottom board and a plurality of connecting boards connecting the corresponding top board and the corresponding bottom board.

17. The LED lamp as claimed in claim 16, wherein the connecting boards are parallel to each other.

18. The LED lamp as claimed in claim 16, wherein the bottom boards of the heat absorbing member cooperatively form a contacting face thermally contacting the heat sink.

19. The LED lamp as claimed in claim 15, wherein an acute angle is defined between a corresponding top board and a corresponding bottom board.

20. The LED lamp as claimed in claim 15, wherein each of the bottom boards has a tip, the tips of the bottom boards put together to form a central portion, the space defined in the top of the heat absorbing member corresponding to the central portion.

* * * * *